US005174743A

United States Patent [19]

Wellman et al.

[11] Patent Number: 5,174,743

[45] Date of Patent: Dec. 29, 1992

[54] POWER FUEL OIL BURNER

[75] Inventors: James E. Wellman; Harley B. Kaplan, both of Fort Wayne; Warren E. Jarvis, Orland, all of Ind.

[73] Assignee: Wayne/Scott Fetzer Company, Fort Wayne, Ind.

[21] Appl. No.: 577,863

[22] Filed: Sep. 5, 1990

[51] Int. Cl.[5] ..... F23C 7/00

[52] U.S. Cl. ..... 431/187; 43/181

[58] Field of Search ..... 431/187, 181, 265; 415/184, 203

[56] References Cited

U.S. PATENT DOCUMENTS

| | | | |
|---|---|---|---|
| 3,079,981 | 3/1963 | Loebel et al. . | |
| 3,220,461 | 11/1965 | Richardson . | |
| 3,406,002 | 10/1968 | Martin . | |
| 3,490,858 | 1/1970 | Fletcher . | |
| 3,733,169 | 5/1978 | Lefebvre . | |
| 3,820,943 | 6/1974 | De Lancey et al. | 431/187 X |
| 3,918,885 | 11/1975 | Palm et al. . | |
| 4,126,410 | 11/1978 | Gerwin . | |
| 4,140,476 | 2/1979 | Kaplan . | |
| 4,311,449 | 1/1982 | Young . | |
| 4,373,901 | 2/1988 | Kaplan et al. . | |
| 4,383,820 | 5/1983 | Camacho . | |
| 4,388,064 | 6/1983 | Kaplan et al. . | |
| 4,424,793 | 1/1984 | Cooperrider . | |
| 4,472,136 | 9/1984 | Lefebvre . | |
| 4,473,349 | 9/1984 | Kumatsu . | |
| 4,484,887 | 11/1984 | Pettersson . | |
| 4,575,332 | 3/1986 | Oppenberg et al. . | |
| 4,701,123 | 10/1987 | Tallman et al. . | |
| 4,780,077 | 10/1988 | Lefebvre . | |

OTHER PUBLICATIONS

Borg-Warner drawing (no date).

*Primary Examiner*—Larry Jones

*Attorney, Agent, or Firm*—George Pappas

[57] ABSTRACT

A power fuel oil burner is provided that includes an electrical motor having a double ended shaft. A squirrel-cage blower overlies the motor. A scroll housing includes a scroll wall that overlies and radially surrounds the blades of the blower. A motor mount integral with the scroll housing supports the motor. The scroll housing is an integral die-cast casting. A fuel pump is driven by a second end of the shaft externally of the scroll housing. A mounting member includes an open cylindrical portion and a radial flange portion. The cylindrical portion is received within the air outlet of the scroll housing, and a cylindrical burner tube is received within the cylindrical portion of the mounting member for communication with the air blower. An integral sheet metal stamped flamelock is disposed within the burner tube downstream of the burner means, is cup-shaped and has an annular frusto-conical portion and an annular ring portion extending radially inward from the frusto-conical portion. The frusto-conical portion includes a plurality of circumferentially-spaced knockouts that are selectively removable. The frusto-conical portion further includes a pair of spaced integral locktabs extending outward therefrom and frictionally engaging the interior surface of the burner tube. The annular ring portion includes a plurality of integral radial slots and vanes for altering airflow through the flamelock.

21 Claims, 2 Drawing Sheets

POWER FUEL OIL BURNER

BACKGROUND OF THE INVENTION

The present invention relates generally to power fuel oil burners.

Power fuel oil burners conventionally include a burner tube having a fuel dispensing nozzle therein, a burner housing having an air discharge opening communicating with the blast tube, a motor driven blower in the housing for providing combustion air to the blast tube, ignition electrodes disposed in the burner tube adjacent the fuel nozzle for igniting the fuel, and a fuel pump driven by the blower motor. The burner housing is typically made of a plurality of parts, either cast or sheet metal, that require assembly. It would be advantageous to provide a burner housing that is substantially integral, thereby improving rigidity and lowering the cost of manufacture and assembly.

A mounting flange is usually also provided around the burner tube by which the burner is mounted to a wall of the heating appliance, with the burner tube extending through an opening in the wall. It would be advantageous to provide a simplified structure for assembling the burner tube to the burner housing and to the mounting flange.

The burner tube often also incorporates a flamelock downstream of the flame that provides for advantageous alteration of the air flow in the vicinity of the flame. It would be desirable to provide an improved configuration of the flamelock that facilitates its assembly to the burner tube and that provides for adjustability of airflow therethrough.

The present invention provides the above discussed desirable advantages as well as other advantages that will be appreciated from the following description of the invention in the context of a preferred embodiment.

SUMMARY OF THE INVENTION

The present invention, according to one aspect thereof, pertains to a fuel oil burner including an electrical motor of the shaded pole induction type including a rotary output shaft having first and second ends extending in opposite directions. A blower of the squirrel-cage type having a wheel centered on and driven by the first end of said output shaft is provided. A plurality of blades are connected to said wheel and arranged circumferentially thereabout, said plurality of blades extending from said wheel toward said motor and overlying said motor frame. A scroll housing includes a sidewall oriented substantially perpendicular to said output shaft adjacent said blower, with said sidewall having an axial air inlet. A scroll wall is oriented substantially perpendicular to said sidewall and extends from said sidewall to overlie and radially surround the blades of said blower. Said scroll wall includes a tangential air outlet. Motor mount means are connected to said sidewall for supporting said motor through said axial air inlet, wherein said sidewall, scroll wall, and motor mount means of said scroll housing are an integral casting. A fuel pump is driven by said second end of said output shaft and supported externally of said scroll housing. Burner means communicating with a source of combustible fuel and with said air outlet for burning said fuel and generating heat is provided.

In accordance with another aspect of the present invention, a power burner includes an air blower having a housing, the housing including an open cylindrical air outlet. A mounting member includes an open cylindrical portion and a flange portion extending radially outward therefrom, the cylindrical portion being received within the cylindrical air outlet of the air blower housing. A cylindrical burner tube has one end thereof received within the cylindrical portion of the mounting member for communication with the air blower. Retaining means passing through aligned apertures in each of the cylindrical air outlet, mounting member and burner tube are provided for retaining the cylindrical air outlet, mounting member and burner tube in an assembled condition. Burner means are located within the burner tube for delivering a combustible fuel to within the burner tube and for causing the combustible fuel to be burned as a flame directed away from the air blower.

In accordance with yet another aspect of the present invention, a power burner includes an air blower and a cylindrical burner tube communicating at one end with the air blower, the burner tube having an interior surface. Burner means are located within the burner tube for delivering a combustible fuel to within the burner tube and for causing the combustible fuel to be burned as a flame directed away from the air blower. A flamelock is disposed within the burner tube downstream of the burner means, the flamelock being an integral sheet metal stamping that is substantially cup-shaped and having an annular frusto-conical portion that increases in diameter in a direction away from the burner means and an annular ring portion extending radially inward from the frusto-conical portion at that end closest to the burner means. The frusto-conical portion includes a plurality of circumferentially-spaced partially-separated knockouts for selective removal to provide adjustment of airflow through the flamelock. The frusto-conical portion further includes a plurality of circumferentially spaced integral locktabs extending outward therefrom and frictionally engaging the interior surface of the burner tube. The annular ring portion includes a plurality of integral radial slots and vanes for altering airflow patterns through the flamelock.

It is an object of the present invention to provide an improved power burner that is economical to manufacture and that is of a compact design.

Additional objects and advantages of the present invention will be apparent from the following descriptions and drawings of a preferred embodiment.

DETAILED DESCRIPTION OF THE PREFERRED EMBODIMENT

Figure 1:
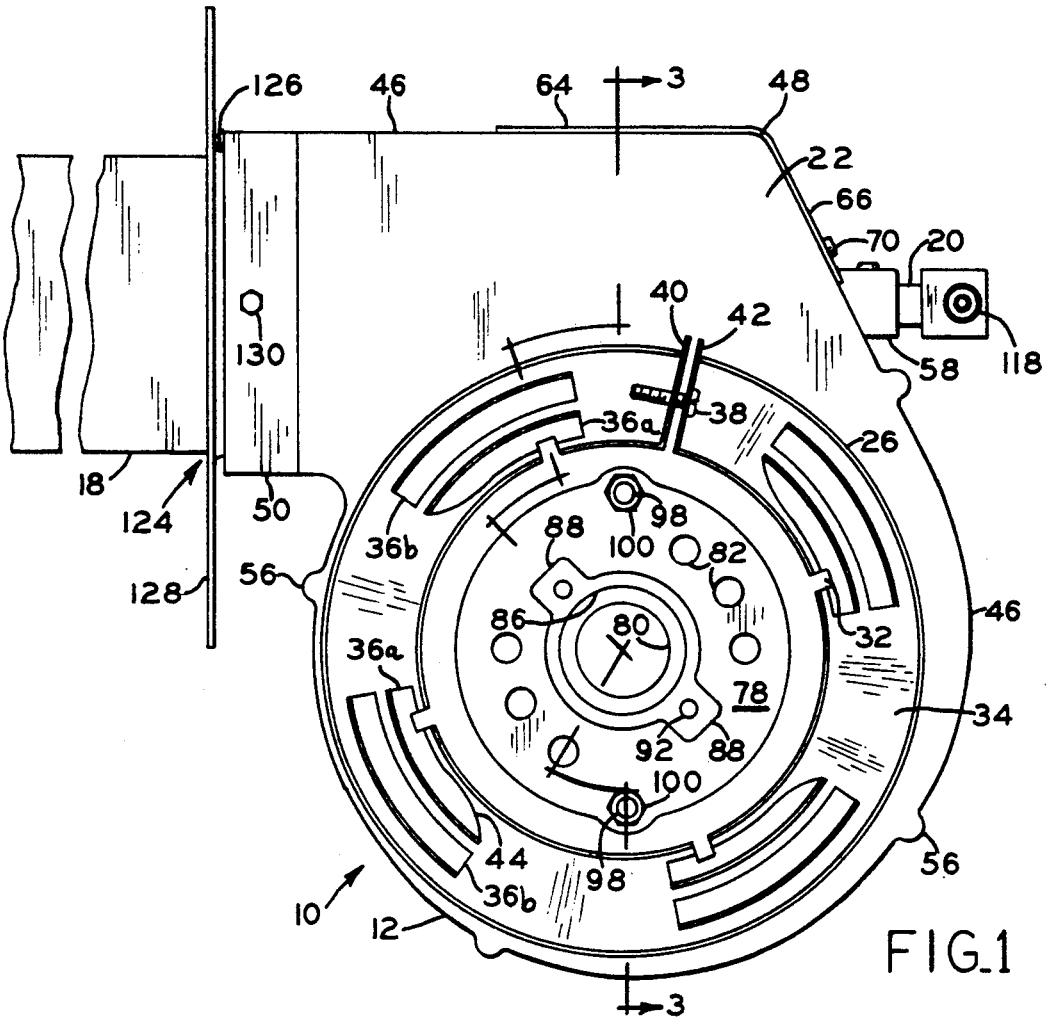
FIG. 1 is a side elevational view of a power burner in accordance with the present invention.
Figure 2:
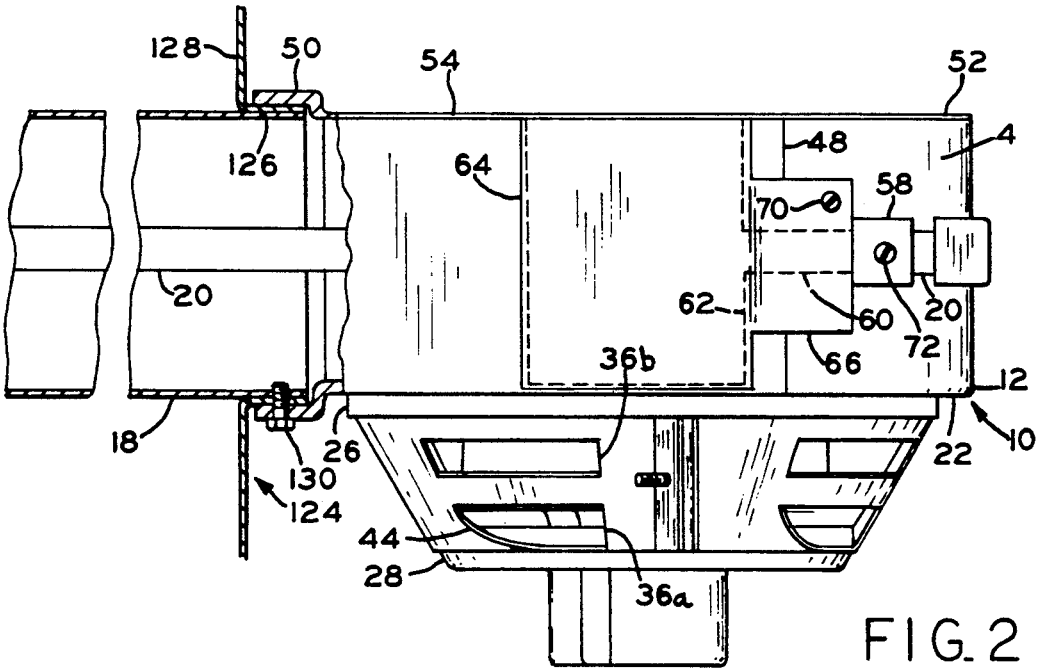
FIG. 2 is a partially cut-away top view of the power burner of FIG. 1.
Figure 3:
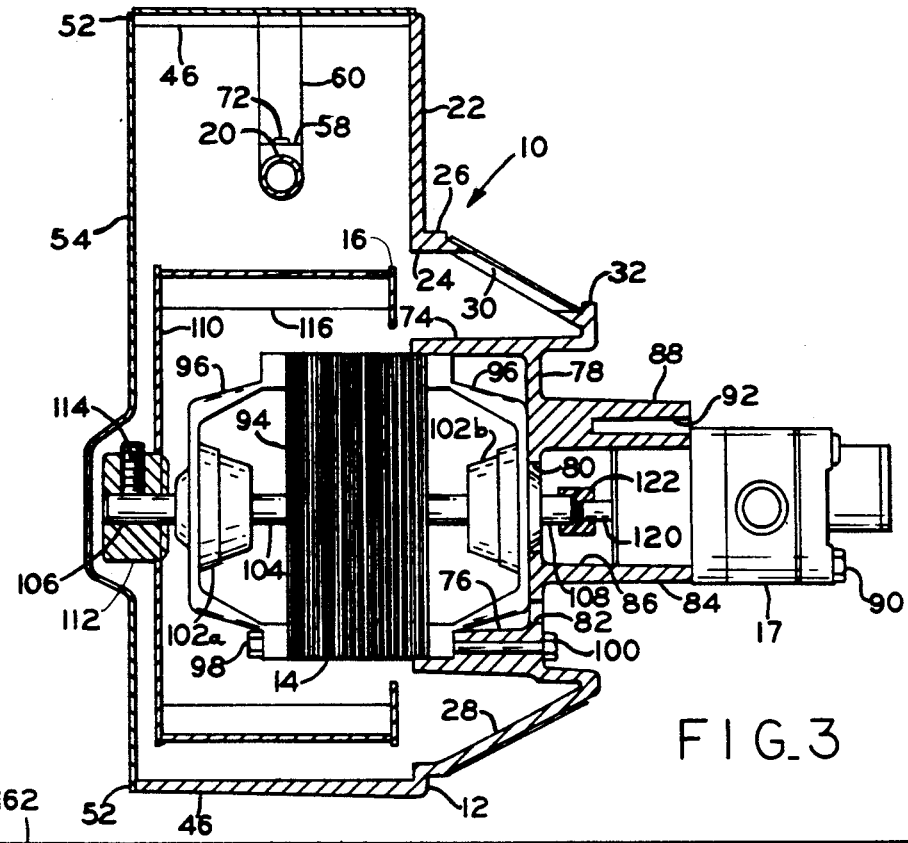
FIG. 3 is a cross-sectional view of the power burner of FIG. 1 taken along section line 3—3 and viewed in the direction of the arrows, and also showing a fuel pump attached to the power burner.

Referring in particular to FIGS. 1-3, there is illustrated a power burner 10 constructed in accordance with the present invention. Burner 10 includes as its main components scroll housing 12, electrical motor 14, squirrel-cage blower 16, fuel pump 17, burner tube 18 and burner assembly 20.

Scroll housing 12 is constructed substantially as a unitary integral aluminum die-casting with a limited number of sheet metal covers. Scroll housing 12 includes a sidewall 22 that is generally flat and has an axial opening 24 therethrough serving as an air inlet. A short cylindrical annular ring 26 extends perpendicularly outward from sidewall 22 and surrounds axial opening 24. A frusto-conical air control ring section 28 extends farther outward from annular ring 26 while tapering radially inward. Four openings 30 are equally spaced circumferentially about air control ring section 28 and each extends therethrough to communicate air from the outside to the interior of scroll housing 12. Each opening 30 is four-sided, with two opposite sides extending radially, and another two opposite sides extending as concentric arcs. At the outer edge of air control ring section 28 are four integral tabs 32 equally spaced circumferentially thereabout and extending radially inward parallel to sidewall 22. Each tab extends over a respective one of openings 30, which permits the underside of each tab to be molded during casting by a die core extending axially through an opening 30, thereby eliminating any necessity for a side-pull core dedicated to moulding only tabs 32.

Overlying air control ring section 28 is a similarly shaped frusto-conical air control band 34 having apertures 36 therethrough that are spaced and shaped substantially similarly to openings 30. More particularly, each aperture 36 is subdivided into inner and outer concentric apertures 36*a* and 36*b*. Air control band 34 can be rotated relative to air control ring section 28 such that apertures 36*a* and 36*b* are fully registered with underlying openings 30, or alternatively, mis-registered to any desired degree to partially occlude openings 30, to thereby restrict air flow through openings 30 into the interior of scroll housing 12. Tabs 32 extend over the outward edge of air control band 34, preventing its escape from air control ring section 28. The tension of air control band 34 can be adjusted by tightening or loosening screw 38 which is threadedly received through band end-wings 40 and 42. Air control band 34 can be fixed in a selected position relative to air control ring section 28 with openings 30 occluded to a selected degree by tightening screw 38 which contracts band 34 in diameter, thus causing band 34 to slide radially outward and jam against the underside of tabs 32, where it is frictionally locked in place. Each of the inner apertures 36*a* is tapered along inner edge 44 such that the radial width of aperture 36*a* decreases in the circumferential direction. This tapering provides for vernier control of air flow through openings 30 as air control band 34 is rotated toward maximum occlusion of openings 30. Absent such tapering, the unoccluded area of openings 30 would be linearly proportional to the angular degree of rotation of air control band 34. This would result in a too rapid percentage change in unoccluded area per degree of rotation near the low end of the air flow adjustment range, making fine adjustment of air flow at low flow rates difficult. By providing tapered apertures 36*a*, for a given amount of change in the unoccluded area of openings 30, the angular rotation needed to effect such change is increased near the low flow end of the adjustment range, making fine tuning easier.

A scroll wall 46 extends perpendicularly from sidewall 22 away from annular ring 26 and air control ring section 28, and overlies and radially surrounds squirrel cage blower 16. Scroll wall 46 wraps around blower 16 such that the radial spacing of scroll wall 46 from blower 16 continuously increases in a spiral while traversing blower 16 circumferentially. At the point of maximum radial departure of scroll wall 46 from blower 16, scroll wall 46 undergoes a sharp bend at point 48 and thereafter extends straight. Scroll wall 46 terminates on diametrically opposite sides of a cylindrical portion 50, and along with sidewall 22 is blended thereto as an integral casting. Rear edge 52 of scroll wall 46 is machined to a flat common plane on which is fitted a sheet metal end cover plate 54. Tapped bosses 56 are distributed around the periphery of scroll wall 46 and each receives a threaded screw that secures end cover plate 54 to machined rear edge 52. A fuel delivery tube retention block 58 is received in slot 60 in scroll wall 46 and includes a bore therethrough that receives fuel delivery tube 132 such that tube 132 extends from scroll wall 46 aligned with the axial centerline of cylindrical portion 50. Grooves located on each side of retention block 58 engage the edges of slot 60 such that retention block 58 can slide along slot 60 for the purpose of insertion of fuel delivery tube 132 into scroll housing 12. The grooves on each side of retention block 58 prevent movement of retention block 58 in the axial direction of fuel delivery tube 132. Thus, the axial position of fuel delivery tube 132 and burner assembly 20 can be fixed in a selected position by set screw 72 extending through retention block 58 and frictionally bearing against fuel delivery tube 132. Slot 60 extends upwardly from retention block 58 toward bend 48 and for a short distance therepast, whereupon slot 60 widens to a rectangular opening 62 in the straight portion of scroll wall 46. Rectangular opening 62 is of substantially the same width as scroll wall 46 and extends to a point about halfway between bend 48 and cylindrical portion 50. Overlying and closing rectangular opening 62 is a sheet metal cover plate 64 having a wing 66 covering slot 60 and traversing bend 48 in close fitting relationship to scroll wall 46. Screw 70 retains wing 66 of cover plate 64 to scroll wall 46, while the opposite end of cover plate 64 is retained by tabs (not shown) extending from cover plate 64 that fit under the edges of rectangular opening 62. Rectangular opening 62 and slot 60 provide an access port through which burner assembly 20 can be inserted into and removed from scroll housing 12.

Cylindrical motor mount 74 extends axially inwardly from the outward edge of air control ring section 28, through axial opening 24, to the plane of the interior surface of sidewall 22. Disposed at diametrically opposite locations on the inner circumference of motor mount 74 are a pair of bosses 76 to which motor 14 is mounted, as explained further below. Spanning the interior of cylindrical motor mount 74 is a disk portion 78 oriented parallel to sidewall 22 of scroll housing 12 and located intermediate the inner edge of motor mount 74 and the outward edge of air control ring section 28. Disk portion 78 has a central aperture 80 therethrough, and a plurality of air holes 82 through which air passes for the purpose of cooling motor 14. Extending outward from disk portion 78 is a cylindrical fuel pump mount 84 disposed coaxial with central aperture 80 and having a cylindrical interior wall 86 and diametrically opposed mounting wings 88 to which fuel pump 17 is attached by bolts 90 received in tapped bores 92. Scroll housing 12, including sidewall 22, air control ring section 28, scroll wall 46, motor mount 74, disk portion 78, and fuel pump mount 84 is cast integrally as a unitary aluminum die-cast casting, thereby providing a housing that is rigid, low in cost, and requiring a minimum number of parts to be assembled.

Motor 14 is an electrical induction motor of the shaded pole type, including field laminations 94 and a motor frame 96 that is assembled to field laminations 94 by a pair of bolts 98 passing through both sides of motor frame 96 and field laminations 94. Bolts 98 also extend through holes in bosses 76 of motor mount 74 to attach motor 14 to scroll housing 12. Bolts 98 are capped by nuts 100 that bear on the outward surface of disk portion 78 to snug motor frame 96 up against bosses 76. Cylindrical motor mount 74 partially surrounds and overlaps laminations 94 to prevent lateral motion of motor 14 relative to scroll housing 12. Each side of motor frame 96 includes bearings 102*a* and 102*b* mounted thereto in which motor shaft 104 is rotatably received. A first end 106 of motor shaft 104 extends through bearing 102*a* and is coupled to squirrel cage blower 16. A second end 108 of motor shaft 104 extends in the opposite direction through bearing 102*b* and is coupled to fuel pump 17.

Squirrel cage blower 16 includes a wheel plate 110 centered on and driven by first end 106 of motor shaft 104 via hub 112 that is fixed to wheel plate 110 and secured to shaft end 106 via set screw 114. Wheel plate 110 extends substantially perpendicular to motor shaft 104. Attached to wheel plate 110 proximate the periphery thereof is a plurality of blades 116 spaced circumferentially thereabout. Blades 116 are disposed parallel to one another and to motor shaft 104, and extend toward motor 14 so as to overlie field laminations 94. Motor 14 is largely surrounded by squirrel cage blower 16, resulting in an overall compactness of design, since more than half of the axial length of motor 14 extends into squirrel cage blower 16. As blower 16 is rotated by motor 14, air is drawn in through openings 30 of air control ring section 28 and also through air holes 82. Air passing through openings 30 is drawn axially along the outer surface of motor mount 74 and laminations 94 of motor 14 to the interior of squirrel cage blower 16, whereupon the air is expelled more or less tangentially outwardly by blades 116 into the interior of scroll housing 12, whereupon the air ultimately exits through cylindrical portion 50 and into burner tube 18 where it supports combustion of fuel introduced by burner assembly 20, described further below.

Fuel pump 17 is a liquid pump of the gear pump type used for delivering liquid fossil fuel such as fuel oil from a reservoir to burner assembly 20 under pressure. While the intermediate piping is not shown in the drawings, fuel pump 17 generally supplies fuel under pressure to port 118 at the rear end of burner assembly 20. Fuel pump 17 includes an input shaft 120 that is axially aligned with second end 108 of motor shaft 104 and coupled thereto in rotary driven engagement by a plastic coupler 122.

Referring in particular to FIGS. 1 and 2, the connection arrangement of scroll housing 12 and burner tube 18 is illustrated. A mounting member 124 includes a sheet metal open cylindrical portion 126 having an outer diameter slightly smaller than the inner diameter of cast cylindrical portion 50 of scroll housing 12, and an inner diameter slightly greater than the outer diameter of burner tube 18. Open cylindrical portion 126 is received in the open end of cylindrical portion 50 in relatively tight-fitting relationship. Extending radially from one end of open cylindrical portion 126 externally of scroll housing 12 is an annular flange portion 128 that is made of sheet metal like that of cylindrical portion 126 and is fixed thereto such as by welding. Flange portion 128 is used for mounting power burner 10 to the wall of the combustion chamber of a furnace or other heat appliance in which power burner 10 is installed. Typically, the wall of the combustion chamber would include a hole of sufficient diameter to admit burner tube 18 therethrough, with flange portion 128 snug up against the outside of the wall and fastened thereto by screws or bolts or other suitable fasteners. Burner tube 18 is retained to scroll housing 12 by being received within open cylindrical portion 128 of mounting member 124 in relatively tight-fitting relationship. The entire assembly constituting scroll housing 12, mounting member 124, and burner tube 18 is secured together by a plurality of circumferentially spaced screws 130 (preferably three screws spaced 120° apart) that are threadedly received in aligned holes in each of scroll housing 12, cylindrical portion 126 and burner tube 18. Screws 130 prevent axial and torsional movement of the three secured elements relative to one another, thereby providing a rigid interconnection of the burner tube, mounting flange and scroll housing that is economical to manufacture and quick and easy to assemble.

Figure 4:
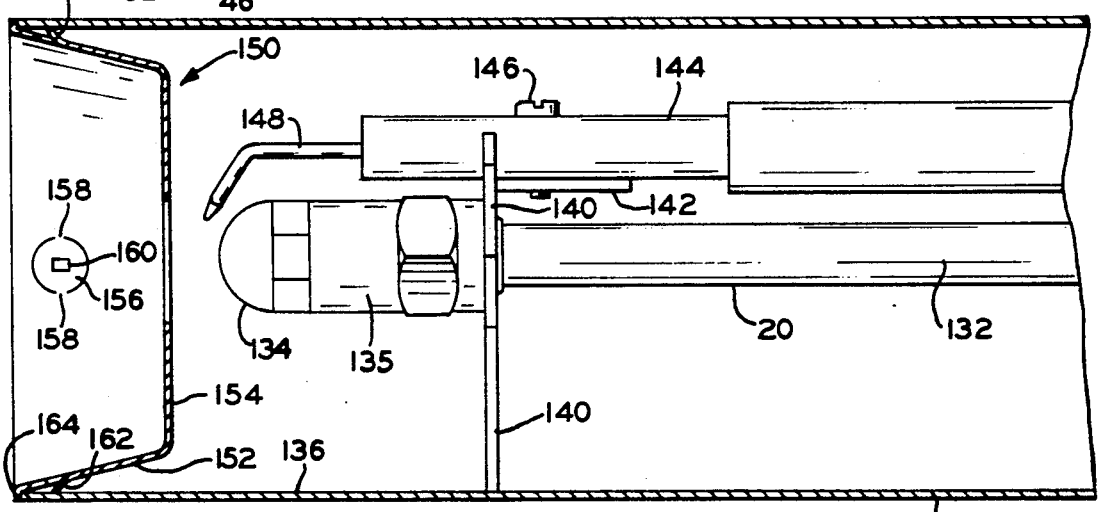
FIG. 4 is a longitudinal cross-sectional view of the burner tube and flamelock of the power burner of FIG. 1.
Figure 5:
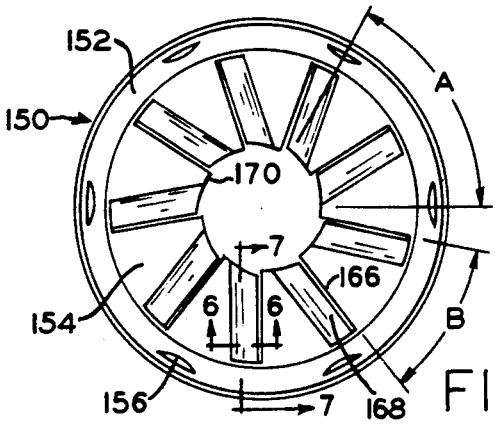
FIG. 5 is an end elevational view of the burner tube and flamelock of the power burner of FIG. 1.
Figure 6:
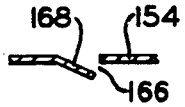
FIG. 6 is a cross-sectional view of a portion of the flamelock of the power burner of FIG. 1, taken along section line 6—6 of FIG. 5 and viewed in the direction of the arrows.
Figure 7:
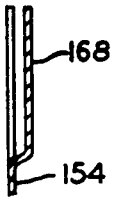
FIG. 7 is a cross-sectional view of a portion of the flamelock of the power burner of FIG. 1, taken along section line 7—7 of FIG. 5 and viewed in the direction of the arrows.

Referring in particular to FIGS. 4 and 5, there is shown an enlarged cross-section of burner tube 18. Disposed within burner tube 18 is burner assembly 20, which comprises a hollow fuel delivery tube 132 terminated by a fuel spray nozzle 134 threadedly received in a nozzle adapter 135. Fuel tube 132 and nozzle 134 are supported relative to interior surface 136 of burner tube 18 by a tripod 138 having legs 140 that extend radially and are spaced about 120° apart. A tab 142 attached to tripod 138 supports an electric arc igniter 144 that is held thereto by screw 146. A pair of electrodes 148 associated with igniter 144 extend in front of fuel spray nozzle 134 and are spaced from each other. An electric arc between electrodes 148 ignites fuel sprayed from nozzle 134.

Disposed in the open end of burner tube 18 is flamelock 150 configured as an integral single-piece sheet metal stamping that is substantially cup-shaped. Flamelock 150 includes an annular frusto-conical portion 152 that increases in diameter in the direction away from burner assembly 20. At the end of frusto-conical portion 152 that is closest to burner assembly 20, an annular ring portion 154 extends radially inward therefrom. Frusto-conical portion 152 has an plurality of equally circumferentially spaced partially separated knockouts 156 that are selectively removable. In the preferred embodiment there are six knockouts 156 distributed circumferentially with an angle A of about 60° between adjacent knockouts. Each knockout 156 is substantially disk-shaped and remains attached to the surrounding frusto-conical portion 152 by diametrically opposed bridges 158. A rectangular aperture 160 is sized and shaped to admit a tool therein such as a screwdriver that can be used to pry out knockout 156 by twisting and breaking bridges 158. By selectively removing some or all of the knockouts 156, the air flow through flamelock 150 can be adjusted to accommodate the selected burn rate of burner assembly 20.

A pair of circumferentially spaced integral locktabs 162 extend outward from frusto-conical portion 152 and frictionally engage the interior surface 136 of burner tube 18. Each locktab 162 is spring biased radially outward and extends toward the open end of burner tube 18 away from burner assembly 20. Flamelock 150 is assembled to burner tube 18 simply and economically by pressing flamelock 150 into the open end of burner tube 18 until annular lip 164 engages the end of burner tube 18. The ends of locktabs 162 dig slightly into the interior surface 136 of burner tube 18, thereby preventing flamelock 150 from falling or being blown out of burner tube 18 after assembly.

A plurality of integral generally radial slots 166 and vanes 168 are disposed in annular ring portion 154 of flamelock 150 for altering the airflow pattern through flamelock 150. More particularly, vanes 168 are oriented to cause rotation of air passing through slots 166 about the longitudinal centerline of burner tube 18 and, thus, about the flame extending from nozzle 134 through central aperture 170 of annular ring portion 154. This rotary air flow results in a more desirable flame pattern and better combustion. In the preferred embodiment, there are nine slots 166 distributed circumferentially with an angle B of about 40° between adjacent slots.

While the present invention has been particularly described in terms of a preferred embodiment, it should be understood that no limitation of the scope of the invention is intended thereby, and that the scope of the invention includes variations, uses or adaptations of the invention following the general principles thereof, including such departures from the present disclosure as come within known or customary practice in the art to which this invention pertains, limited only by the claims appended hereto.

What is claimed is:

1. A fuel oil burner comprising:

an electrical motor including a rotary output shaft having first and second ends extending in opposite directions;

a blower of the squirrel-cage type having a wheel centered on and driven by the first end of said output shaft, and a plurality of blades connected to said wheel and arranged circumferentially thereabout, said plurality of blades extending from said wheel toward said motor and overlying said motor;

a scroll housing including a sidewall adjacent said blower, said sidewall having an axial air inlet, a scroll wall extending from said sidewall to overlie and radially surround the blades of said blower, said scroll wall having a tangential air outlet, motor mount means connected to said sidewall for supporting said motor through said axial air inlet, wherein said sidewall, scroll wall, and motor mount means of said scroll housing are an integral casting;

a fuel pump driven by said second end of said output shaft and supported externally of said scroll housing; and burner means communicating with a source of combustible fuel and with said air outlet for burning said fuel and generating heat.

2. The fuel oil burner of claim 1, in which said electrical motor is a shaded-pole induction motor.

3. The fuel oil burner of claim 1, and further including an annular air control ring section surrounding said axial air inlet and disposed between said sidewall and said motor mount means.

4. The fuel oil burner of claim 3, in which said air control ring section includes a first air opening therethrough and an annular air control band is disposed circumferentially about said air control ring section, said air control band including a second air opening therethrough corresponding to said first air opening, and said air control band being rotatable relative to said air control ring section to provide for selective occlusion of said first air opening.

5. The fuel oil burner of claim 4, in which said air control ring section is frusto-conical, tapering radially inward in a direction axially away from said sidwall.

6. The fuel oil burner of claim 4, in which said first air opening is four-sided, including two sides substantially aligned with radial planes of said output shaft, and two other sides substantially transverse to radial planes of said output shaft.

7. The fuel oil burner of claim 6, in which the second air opening of said air control band corresponds in shape and size to said first opening of said air control ring section.

8. The fuel oil burner of claim 6, in which the second air opening of said air control band includes at least one transverse side that tapers inwardly relative to said second opening in the plane of said second opening to restrict the area of said second opening relative to said first opening, to provide vernier control of airflow through said first opening at low airflow settings.

9. The fuel oil burner of claim 1, in which the blades of said squirrel-cage blower are substantially parallel to each other and to said output shaft.

10. The fuel oil burner of claim 9, in which the sidewall of said scroll housing is disposed adjacent said blower on a side opposite said wheel of said blower.

11. The fuel oil burner of claim 1, in which said motor mount means includes a cylindrical portion extending through said axial air inlet and at least partially surrounding said motor.

12. The fuel oil burner of claim 11, in which said cylindrical portion of said motor mount includes a disk portion transverse to said output shaft of said motor, said disk portion including a drive aperture through which the second end of said motor output shaft extends.

13. The fuel oil burner of claim 12, and including a fuel pump mount surrounding said drive aperture and extending axially outward therefrom, said fuel pump being mounted to said fuel pump mount.

14. A fuel oil burner comprising:

an air blower having a housing, said housing including an open cylindrical air outlet;

a mounting member including an open cylindrical portion and a flange portion extending radially outward therefrom, said cylindrical portion being received within said cylindrical air outlet of said air blower housing;

a cylindrical burner tube having one end thereof received within said cylindrical portion of said mounting member for communication with said air blower;

retaining means for retaining said cylindrical air outlet, mounting member and burner tube in an assembled condition; and burner means located within said burner tube for delivering a combustible fuel to within said burner tube and for causing the combustible fuel to be burned as a flame directed away from said air blower.

15. The fuel oil burner of claim 14, in which said retaining means includes aligned apertures in each of said cylindrical air outlet, mounting member and burner tube, threading in at least the aperture of said burner tube, and a correspondingly threaded screw threadedly received in at least the threaded aperture of said burner tube.

16. The fuel oil burner of claim 15, including a plurality of threaded apertures in at least said burner tube, a corresponding plurality of apertures in said cylindrical air outlet and mounting member aligned with the threaded apertures of said burner tube, and a plurality of threaded screws received one in each of said threaded apertures.

17. A fuel oil burner comprising:

an air blower;

a cylindrical burner tube communicating at one end with said air blower, said burner tube having an interior surface;

burner means located within said burner tube for delivering a combustible fuel to within said burner tube and for causing the combustible fuel to be burned as a flame directed away from said air blower; and a flamelock disposed within said burner tube downstream of said burner means, said flamelock being an integral sheet metal stamping that is substantially cup-shaped and having an annular frusto-conical portion that increases in diameter in a direction away from said burner means and an annular ring portion extending radially inward from said frusto-conical portion at that end closest to said burner means, said frusto-conical portion including a plurality of circumferentially-spaced partially-separated knockouts for selective removal to provide adjustment of airflow through said flamelock, said frusto-conical portion further including a plurality of circumferentially spaced integral locktabs extending outward therefrom and frictionally engaging the interior surface of said burner tube, said annular ring portion including a plurality of integral radial slots and vanes for altering airflow patterns through said flamelock.

18. The fuel oil burner of claim 17, in which said plurality of knockouts includes six knockouts spaced about 60° apart.

19. The fuel oil burner of claim 17, in which said frusto-conical portion further including a plurality of circumferentially spaced integral locktabs extending outward therefrom and frictionally engaging the interior surface of said burner tube.

20. The fuel oil burner of claim 19, in which the plurality of locktabs includes a pair of locktabs spaced about 180° apart.

21. The fuel oil burner of claim 17, in which the plurality of integral slots includes nine slots spaced about 40° apart.

* * * * *